US009469986B2

(12) United States Patent
Connell

(10) Patent No.: US 9,469,986 B2
(45) Date of Patent: Oct. 18, 2016

(54) FIREPROOF REFUGES

(71) Applicant: Ross Malcolm Connell, Tyabb (AU)

(72) Inventor: Ross Malcolm Connell, Tyabb (AU)

( * ) Notice: Subject to any disclaimer, the term of this patent is extended or adjusted under 35 U.S.C. 154(b) by 0 days.

(21) Appl. No.: 14/620,239

(22) Filed: Feb. 12, 2015

(65) Prior Publication Data

US 2015/0152636 A1 Jun. 4, 2015

Related U.S. Application Data

(63) Continuation-in-part of application No. 13/500,304, filed as application No. PCT/AU2010/001306 on Oct. 5, 2010, now abandoned.

(30) Foreign Application Priority Data

Oct. 5, 2009 (AU) ..... 2009904831

(51) Int. Cl.

| | |
|---|---|
| ***E02D 27/00*** | (2006.01) |
| ***E04B 1/94*** | (2006.01) |
| ***E04H 9/16*** | (2006.01) |
| ***A62C 27/00*** | (2006.01) |
| *E04H 1/12* | (2006.01) |

(52) U.S. Cl.

CPC ..... *E04B 1/94* (2013.01); *A62C 27/00* (2013.01); *E04H 9/16* (2013.01); *E04H 1/12* (2013.01); *E04H 1/1261* (2013.01)

(58) Field of Classification Search

CPC ..... E04H 9/16; E04H 1/1261; E04H 1/94; E04H 1/12

USPC ..... 52/79.1, 309.8, 439, 36.1, 232, 106, 52/234, 169.6, 168, 745.15, 19, 745.19, 52/745.2, 404.1, 309.11, 309.9, 406.3, 52/405.3, 405.4, 404.2, 407.4, 309.1; 109/28, 29, 53, 55, 49.5, 82, 84, 83, 85

See application file for complete search history.

(56) References Cited

U.S. PATENT DOCUMENTS

| | | | |
|---|---|---|---|
| 3,492,767 | A | 2/1970 | Pincus |
| 3,909,907 | A | 10/1975 | Davis |
| 4,075,798 | A | 2/1978 | Tazaki |
| 4,126,972 | A | 11/1978 | Silen |

(Continued)

FOREIGN PATENT DOCUMENTS

| | | |
|---|---|---|
| AU | 567145 | 8/1984 |
| EP | 0023621 | 2/1981 |
| GB | 2173838 | 11/1986 |

*Primary Examiner* — Chi Q Nguyen

(74) *Attorney, Agent, or Firm* — Pedersen and Company, PLLC; Ken J. Pedersen; Barbara S. Pedersen

(57) ABSTRACT

A dry refuge for a group of people in the event of a large fire front like a bush fire is a chamber with a roof, walls and doors made of a steel outer shell, a non-metal inner shell to accommodate people and a multi-layer ceramic fiber insulation layer between the shells capable of withstanding 1100EC difference in temperature. When the refuge is mobile in order to accompany firefighters into a fire zone, it is built as an insulated water tank with entry hatches for personnel and a quick release water valve for dumping water from the inner shell. The tanks may be on road going trailers in order to be transportable by the authorities to where they are needed. An air portable version is transportable by helicopter. All may have smoke proof seals on hatches and doors and internal air supply, sight glasses to view the outside, interior lighting and a radio.

7 Claims, 8 Drawing Sheets

(56) References Cited

U.S. PATENT DOCUMENTS

| | | | |
|---|---|---|---|
| 4,160,340 | A | 7/1979 | Levett |
| 4,174,711 | A | 11/1979 | Laing et al. |
| 4,301,631 | A | 11/1981 | Tazaki |
| 4,662,287 | A | 5/1987 | Connell |
| 4,788,802 | A | 12/1988 | Wokas |
| 5,069,358 | A | 12/1991 | Avery, Jr. |
| 5,615,424 | A | 4/1997 | Nakata |
| 5,921,043 | A | 7/1999 | McDonald |
| 5,930,966 | A | 8/1999 | Wood et al. |
| 6,226,932 | B1 | 5/2001 | Friedrich |
| 6,438,906 | B1 | 8/2002 | Komarowski |
| 7,997,441 | B2 | 8/2011 | Marcel |
| 2006/0048458 | A1 | 3/2006 | Donald et al. |
| 2009/0031621 | A1 | 2/2009 | Kitagawa |
| 2011/0083380 | A1 | 4/2011 | Thomas |
| 2012/0192503 | A1* | 8/2012 | Connell ..... E04H 9/16 52/79.1 |

* cited by examiner

FIREPROOF REFUGES

CROSS-REFERENCES TO RELATED APPLICATIONS

This application is a continuation-in-part of application Ser. No. 13/500,304, filed Apr. 4, 2012 and also titled "Fireproof Refuges". The disclosure of said prior application and its entire file wrapper (including all prior art references cited therein) are hereby specifically and expressly incorporated by reference in their entirety as if set forth fully herein.

TECHNICAL FIELD

This invention concerns temporary refuges for personnel in the event of fire. These are classified as active safety measures.

BACKGROUND

Although fires in buildings consume the fuel inside the building and may persist until the fuel is exhausted or the fire is extinguished by firefighters, the behaviour of a bush fire is different in that a fire front forms and travels over the ground according to various conditions which determine direction and speed.

Sometimes firefighting vehicles become isolated then surrounded by fire and the crew have no means of escape. Residences which are reached by only one road in a rural setting may become similarly surrounded by fire leaving the occupants trapped. The building codes do not yet specify that residences shall have fireproof construction. Accordingly some householders rely on bunkers into which they retreat in the event of a bush fire. Unless these are purpose-built they may provide inadequate protection and death or injury results.

The heat of a bush fire can be high over a short period as the fire front advances, consumes oxygen and creates smoke. Any refuge must therefore offer effective heat insulation, a physical barrier to smoke, windblown debris and embers, and an air supply in the event that the design limit of the refuge is exceeded by crowding.

In U.S. Pat. No. 4,174,711 is a fireproof shelter for installation inside a building. The shelter's wall is 12-20 cm thick with chrome plating or gold finish. Crystal hydrates inside the shelter absorb incoming heat and the occupants spray themselves with water. While it may be possible to use such shelters within buildings, the design of shelters for bush fire resistance and for mobile use on roads or across country requires a different approach.

In my Australian Patent No. 567145 I set forth a mobile refuge in the form of a water tank which is heat insulated sufficiently to withstand a moving fire front with hatches for rapid entry of persons who dump the water in the tank through a rapid discharge valve as they enter and remain inside for the duration of the emergency. The requirements of a dry refuge to which a family may retreat introduces different requirements from the tank version which are addressed by this invention.

SUMMARY OF INVENTION

The first apparatus aspect of the invention provides a refuge for temporarily housing people in the event of fire, being a chamber with walls, a roof and a door constructed from an outer metal shell which is attachable to a fireproof base, and an inner shell which provide accommodation for people, the space between the shells being insulated with ceramic fibre.

Preferably the door is of like construction to a wall of the chamber.

The metal may be corrosion resistant alloy sheet 1-2 mm thick. This gives the chamber an outdoor life of at least 20 years. It is preferable that the inside face of the sheet be uncoated in order to avoid the generation of vapour or smoke which could adversely affect the occupants. The chamber may be cuboid and accommodate four or more persons.

The inner shell may be made of fibreglass and resin formed as a tank. Alternatively the inner shell may be a rotational moulding around which the metal shell is built.

The insulation may be applied to one or other of the shells in layers. The insulation may be in sheet form or as a flexible blanket. The inner or outer shells may have surface mounted spikes which pierce the insulation and keep it in position.

The chamber may have an external air duct which joins the chamber interior to a storage chamber capable of accommodating one or more oxygen/air bottles. The storage chamber walls and the duct preferably have walls built to the same standard of thermal insulation as the chamber. Alternatively, the chamber may have storage space for breathing apparatus.

The second aspect of the invention provides a water tank for a fire tanker which has multiple doors for admitting firefighters and a dump valve for releasing water rapidly, the tank being of the same construction as the chamber described above. The chamber may have an air duct which joins the interior to a storage chamber capable of accommodating a compressed air supply. Alternatively, the interior of the chamber may have waterproof breathing apparatus.

The chamber may be cuboid and large enough to house four six or eight persons. The doors may be in the top face of the chamber opening outwards. The doors may be insulated to the same standard and have door seals which cooperate with chamber seals effecting a double or labyrinth seal. The doors may have a convex exterior section. The interior may have baffles to quell water movement when the tank is full or partly full. The baffles may divide the interior into compartments for occupants. The interior may have lighting, a waterproof radio or phone, and an insulated aerial. A fire crew has six members.

The third aspect of the invention provides a trailer-mounted refuge for temporarily housing people in the event of fire, comprising a chamber with multiple doors securable to the floor of a road going trailer. The chamber having the same wall construction as described above. A storage chamber for the compressed air supply may be joined to the interior by a duct. The position of the doors may vary.

Such units would be brightly coloured for identification and have fluoro patches for detection from the air. These could be available from hire businesses or rural councils to be maintained and inspected while they wait to be used for fire protection. Here the protection of personnel is the aim rather than the dual function of water storage and personnel protection.

The fourth apparatus aspect of the invention provides a standalone refuge for temporarily housing people in the event of fire, comprising a chamber with multiple doors with a wall construction as described above and an optional water dump valve and lugs for slinging the refuge from a helicopter.

The chamber may contain a water pump facility for changing the interior with water from an external source. Preferably the chamber will have adjustable floor supports for resting the chamber on uneven ground.

The fifth apparatus aspect of the invention provides a dry refuge for housing people in the event of fire comprising a chamber, having one or two doors, walls and a roof and optionally a floor made of the same wall construction as described above. The floor may have adjustable supports to assist its placement on the ground. The chamber may be of modular construction with identical ends and intermediate modules so that the length was variable. The chamber may sit within an external frame in order to protect the roof from falling debris. The frame may have a lengthwise ridge member to withstand collapsing poles and the like. Lifting lugs allow placement by a crane. The roof profile may be arcuate. The modules may be rotational mouldings which are covered with insulation, joined together by connectors and placed within an outer steel shell.

If the refuge is designed to be fixed to a concrete base, the base frame need not be insulated like the other parts of the refuge. The base frame may be adapted to be picked up by a forklift. The refuge may have an external or internal air supply for the occupants.

Alternatively, the unit may have inner and outer like frames, one resting within the other, the inner being sheathed in plywood or plastic to which is attached the requisite insulation as described above, the outer frame being sheathed in sheet metal attached by fasteners.

The interior may have battery powered lights, peepholes, communication equipment and seating.

BRIEF DESCRIPTION OF DRAWINGS

One embodiment of the invention is now described with reference to the accompanying drawings, in which.

DESCRIPTION OF EMBODIMENTS

Figure 1:
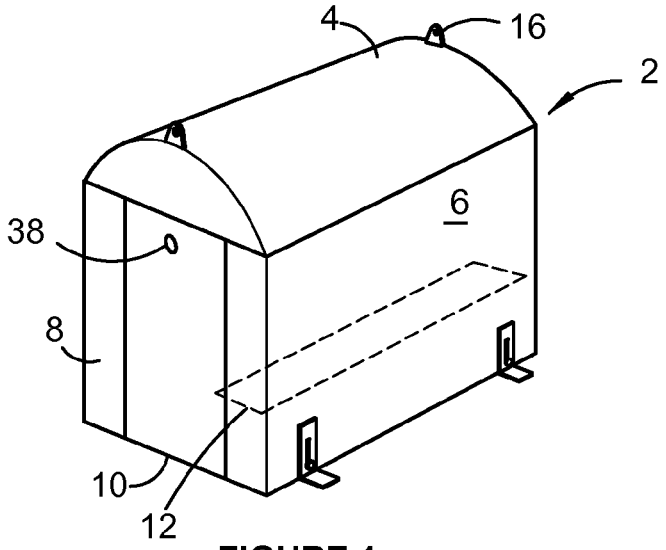
FIG. 1 is a perspective of a dry refuge for temporary or permanent ground installation in rural areas.
Figure 2:
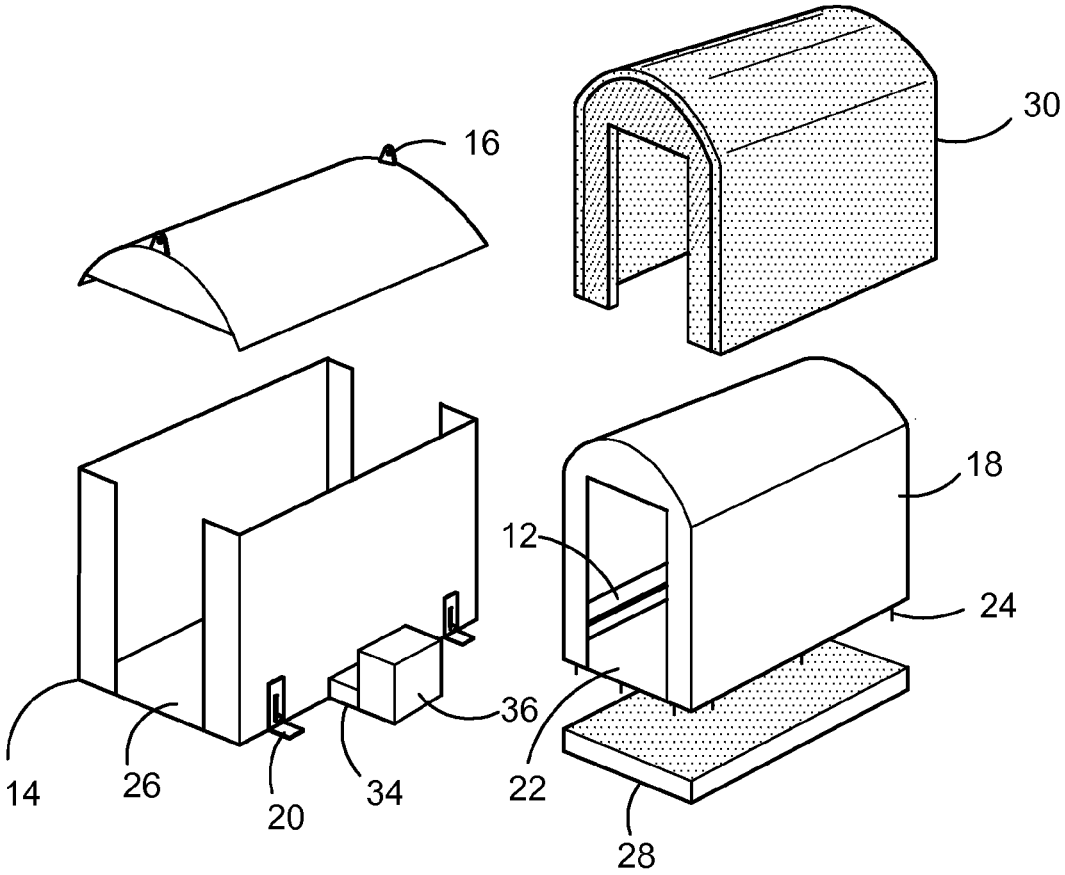
FIG. 2 is a perspective of the outer shell and the inner shell of the refuge of FIG. 1.

Referring now to FIGS. 1 and 2, dry refuge 2 is 1800 mmW×2400 mmL×2000 mmH with an arcuate roof 4, side walls 6 and end walls 8. A door 10 opens outwards in each end wall 8. Seats 12 accommodate six persons.

Figure 3:
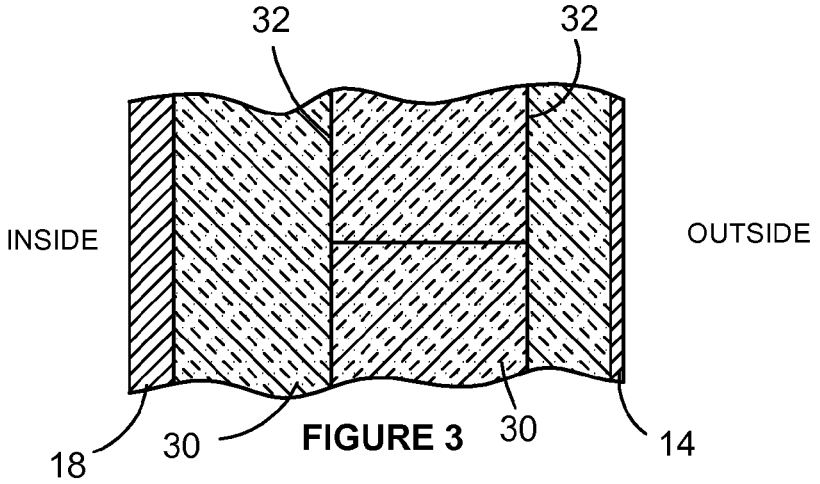
FIG. 3 is a cross section of the wall of the refuge of FIG. 1.

FIGS. 2 and 3 show the construction. Outer box shell 14 is made from 1.4 mm stainless steel sheet with a bolt on arcuate roof 4. The roof has lifting lugs 16. Inner shell 18 is a rotational moulding. Alternatively shell 18 is a fibreglass reinforced epoxy resin box laid on a mould and later joined to its floor. Brackets 20 bolt to the outer shell and assist placement or anchorage. The floor 22 of the inner shell is bored to receive rows of spacers 24 which lift the inner shell 18 off the floor 26 of the outer shell. A pad 28 of ceramic fibre insulation underlies the inner shell. In a variant, the shells are fixed to a rectangular steel frame which rests on the ground.

The inner shell is covered with a blanket 30 of the same ceramic fibre insulation to a sufficient depth to safely thermally insulate the inner shell even if the outer shell is exposed directly to the fire front. The insulation is supplied in rolls and can be laid over the inner shell as shown until the required depth is built up. The density of this fibre is important. Three layers of fibres are preferable, separated by intermediate adhered layers of aluminium foil 32. The edges of the blankets are butted. The use of three layers allow the joins to be overlaid by the next layer. The fibre face slides over the foil face easily which assists in the cladding stage.

Door 10 is 900 mm wide and 1800 mm high and is mounted to open outwards. It is of the same insulated construction as the welds. Insulated duct 34 connects the interior of the inner shell to an insulated box 36 which houses gas bottles containing compressed air. A valve operable from the interior of the inner shell allows occupants an extra air supply. The volume of the inner shell is about 4200 l. Six persons may require 360 l/air per minute. As the percentage of carbon oxide in the air rises respiration rate also rises but is offset by the ingress of bottled air. The aim is to provide a refuge period of 20 minutes with the door closed. A sight glass 38 in the door allow the occupants to see outside and judge when it is safe to emerge. A tube carries an outer low expansion glass lens and an inner plain lens.

Refuges of this type of construction allow rises of less than one degree centigrade when exposed to a passing fire front.

Figure 4:
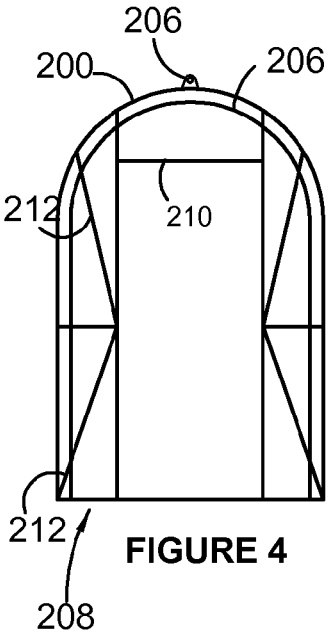
FIG. 4 is an end view of the nested frames of a variant dry refuge ready to be clad.
Figure 5:
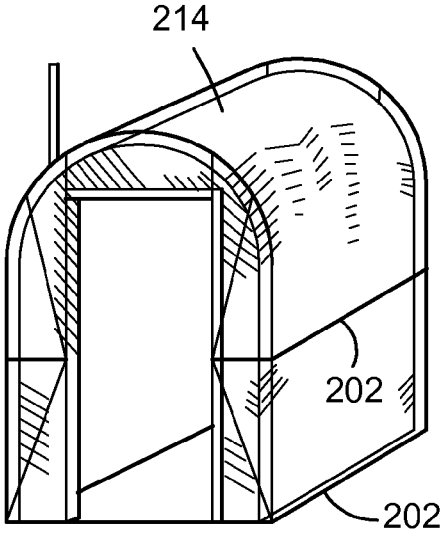
FIG. 5 is a perspective of the nested frames of FIG. 11 with the inner frame clad with ply.
Figure 6:
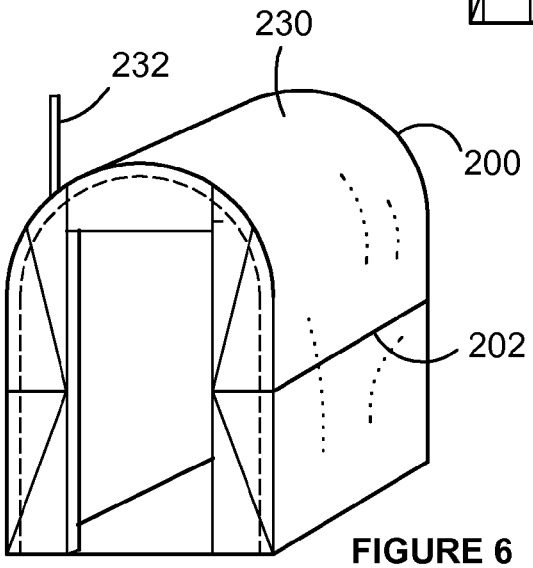
FIG. 6 is the same view as FIG. 9 but with the ply sheath covered with insulation to the depth of the outer frame, ready to receive the steel sheet layer.

An alternative construction is described in FIGS. 4-6. The refuge has an outer frame 200 with an arched roof made of metal bars 202 and a smaller inner frame 204 also made of metal bars nesting within the outer frame. Lifting lugs 206 allow the unit to be craned.

Each end wall 208 has a doorway 210. Both frames are interconnected by ties 212. Bending plywood 214 (see FIG. 11) is screwed to the inner frame to form a cabin. Nails are driven through the ply from the interior towards the outer frame. These hold the insulation batts or blankets 230 referred to above. The end walls 208 are likewise sheathed and insulated.

The outer frame 200 is then sheathed in stainless steel sheet (not shown) which is rivetted to the bars. An insulated aerial 232 allows radio and phone reception despite the screening imposed by the metal sheet. The doors and door frame edges incorporate the double seal described above.

Figure 7:
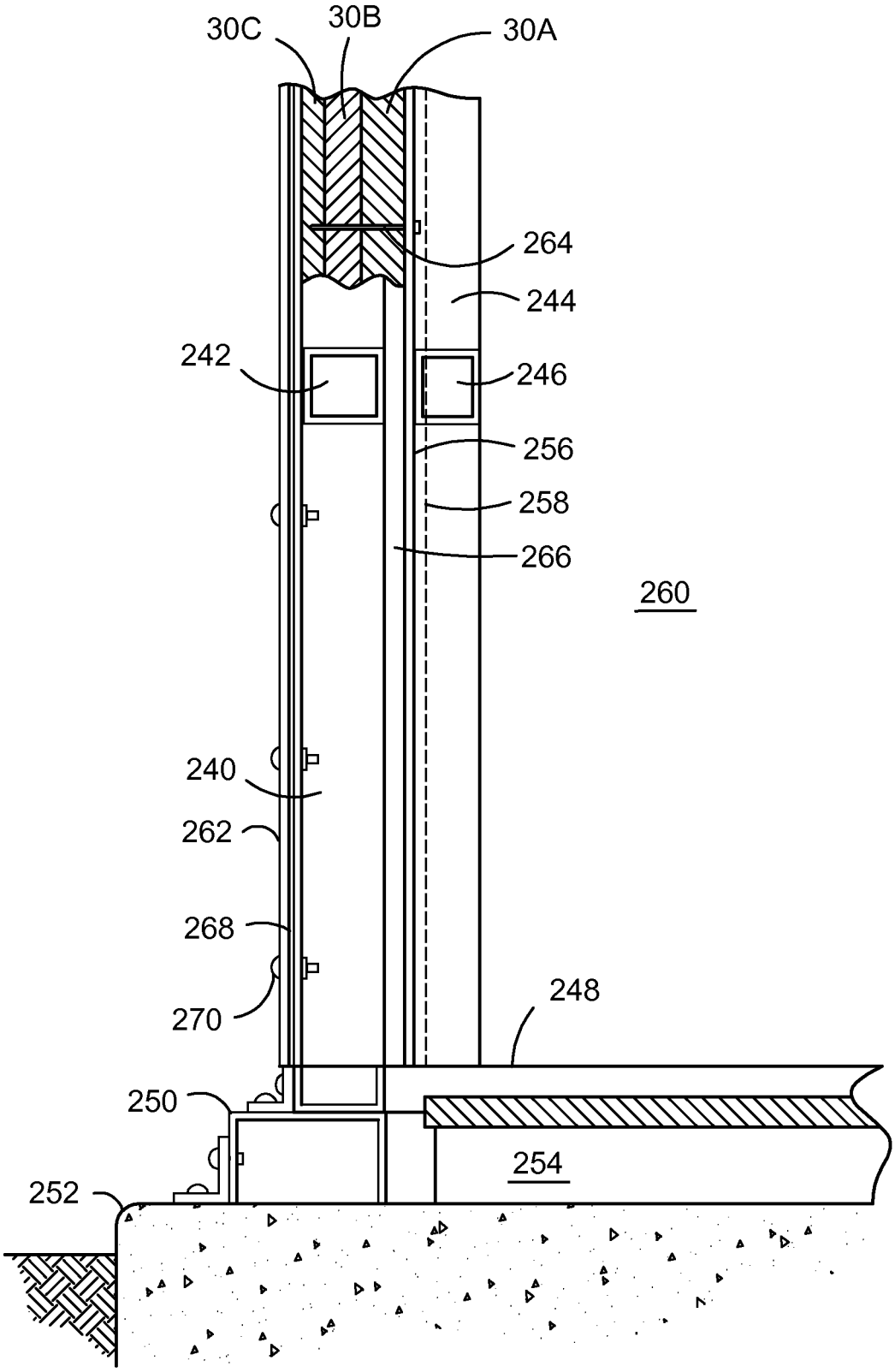
FIG. 7 is a fragmentary end section of the dry refuge shown in FIGS. 4-6 standing on a slab with the insulation partially removed for clarity.

Referring now to FIG. 7, in this version the outer frame 200 consists of hoops 240 made of angle iron connected by horizontal tubular ties 242. Inner frame 204 likewise consists of hoops made of angle iron 244 connected by horizontal tubular ties 246. The ends of the two nesting frames are welded to inverted steel channel 248 which in turn is welded to rectangular base channel 250. Concrete slab 252 may be in the garden of a house in a bush fire area. Aluminium bearers 254 support a pair of platforms made of particle board. These are carried through the door and placed on the slab 252. The rectangular base 250 can be carried by a forklift.

Flexible plastic panels 256 are passed through the outer frame and screwed to ties 246 and to the flanges 258 of the hoops 244. A multi-ply composite of plastic and aluminium sheets allow the inner shell to be curved by bending to allow other methods of fabrication.

The end walls are clad in the same way. Sealing tape is applied to the edges. The end walls have an edge flange which overlies the side walls. The seal lies between the wall and the flange. A shelter room 260 for the occupants with a pair of doors results.

Stainless steel panels 262 are next offered up to the hoops of the outer frame 200 and drilled to locate fixing sites in the angle iron 240. The panels are then parked while the cladding ensues.

Panels 256 of the shelter room are drilled in a pattern in order to allow roofing nails 264 to be push fitted into the space 266 between the inner and outer frames. A roll of 160 kg/m$^3$ ceramic fibre (ISOWOOL) 30A is laid over the panels 256. A second layer 30B of the same material increases the thickness followed by a third layer 30C of 128 kg/m$^3$ of half the thickness. This produces a 62 mm layer of thermal insulation which entirely occupies space 266. The nails are pushed outward to pierce the insulation layers. Adhesive applied to the nail head prevents its return.

The external faces of the hoops of the outer frame 200 and the ties 242 are covered with strips of sealing tape 268. The steel panels 262 are then re-offered to the outer frame and attached by rivets 270.

Figure 8:
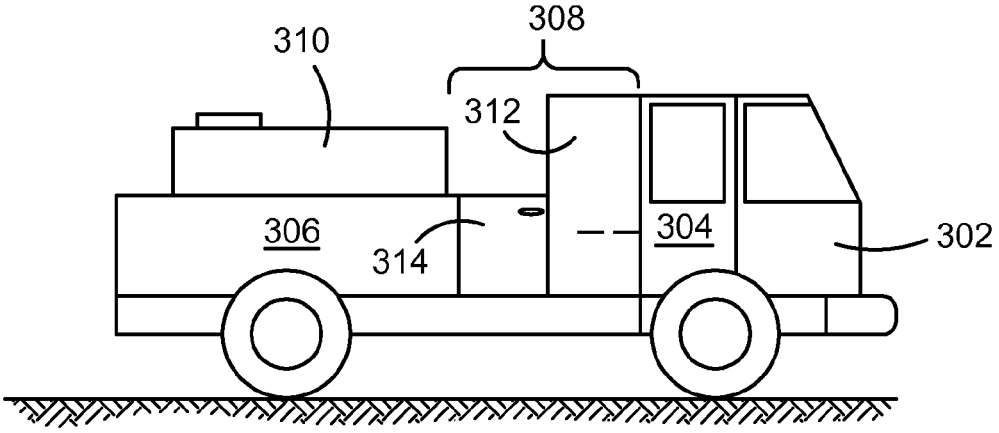
FIG. 8 is a side view of a firefighting, water carrying truck with an integral refuge for firefighting crew.
Figure 9:
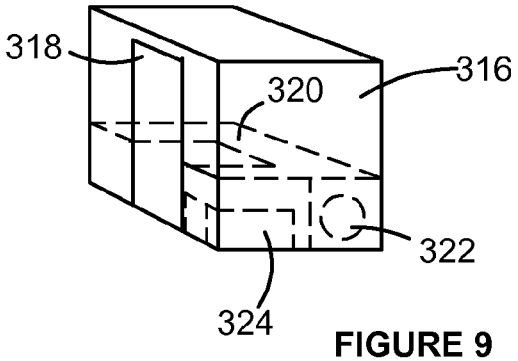
FIG. 9 is a perspective of the interior layout of the refuge in FIG. 8.

Referring to FIGS. 8 and 9, the cab 302 has exterior lights and speakers and a rear section 304 with its own doors 306 and interior seating (not shown) for fire crew.

Gap 308 separates the rear section 304 from the water tank 310 and houses shelter 312 and gate 314 giving access to shelter 312. Into this gap 308 is fitted the cuboid refuge 316 shown in FIG. 9. This is 2500 mm long so as to fit within the trucks chassis width and the width is such as to accommodate a door 318 and interior seating 320. Beneath seating 320 is the vehicle fuel tank 322 and 24v battery system 324. These receive the same degree of heat insulation as the crew. In some vehicles the gap 308 may be smaller in which case the door 318 is in the end wall.

The construction of the refuge itself as described in relation to FIGS. 1-3 with a fibreglass interior shell, a stainless steel exterior shell and 62 mm of ceramic fibre insulation.

Figure 10:
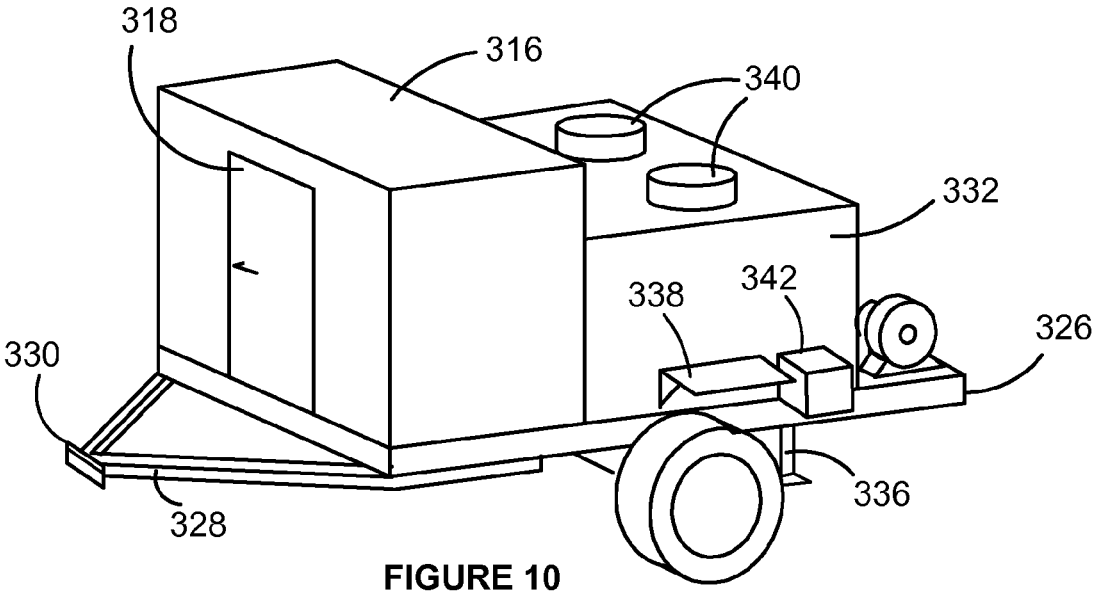
FIG. 10 is a perspective of a road trailer with a water tank which doubles as a fire refuge with an optional refuge as shown in FIGS. 8 and 9.

Referring now to FIG. 10, the refuge is mounted on a trailer 326 having a single pair of wheels and an A-frame tow bar 328 which attaches to the truck via a RINGFEDER® hitch 330.

The main part of the trailer supports a 2500 l water storage tank 332 of the type used by rural property owners where mains water is not available. If a source of bulk water such as a swimming pool is not available, a tank on a trailer can be filled at a pump station and kept for firefighting duty.

The dry refuge 316 with walls, roof and floor is insulated with ceramic fibre. Tow bar 328 permits mobile deployment and typically it would have dual use, primarily as a permanent source of hose water, but secondarily as a fireproof refuge for the rural residents.

Persons wishing to use the trailer refuge can mount the steps 336 and 338 to open hatches 340 in order to release the tank water through duct 342. The hatches 340 give access to the operating rod and dump valve shown in FIGS. 12-14.

Figure 11:
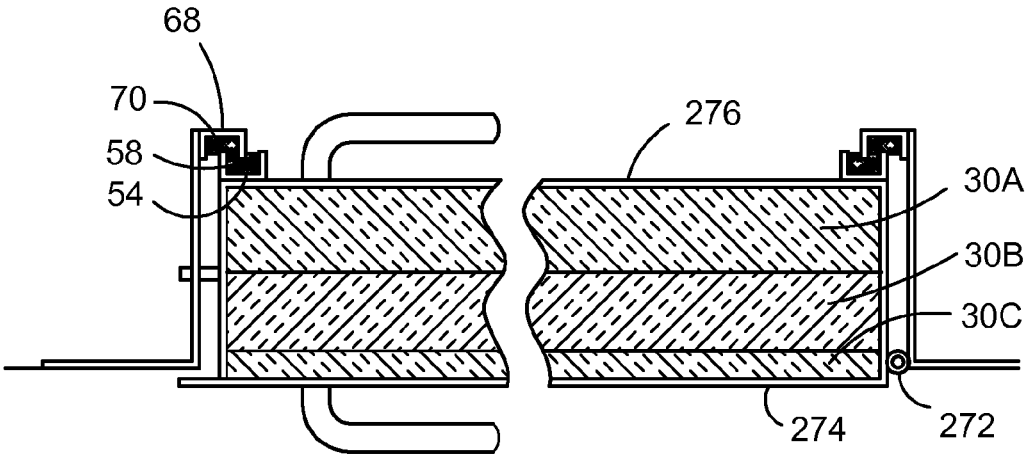
FIG. 11 is a section through the rectangular door shown in the end wall of the dry refuge in FIG. 10.

The door shown in FIG. 11 hangs by four hinges 272 from the refuge wall. The door is made from outer and inner panels 274, 276 with insulation layers 30A, 30B and 30C between the panels.

Figure 15:
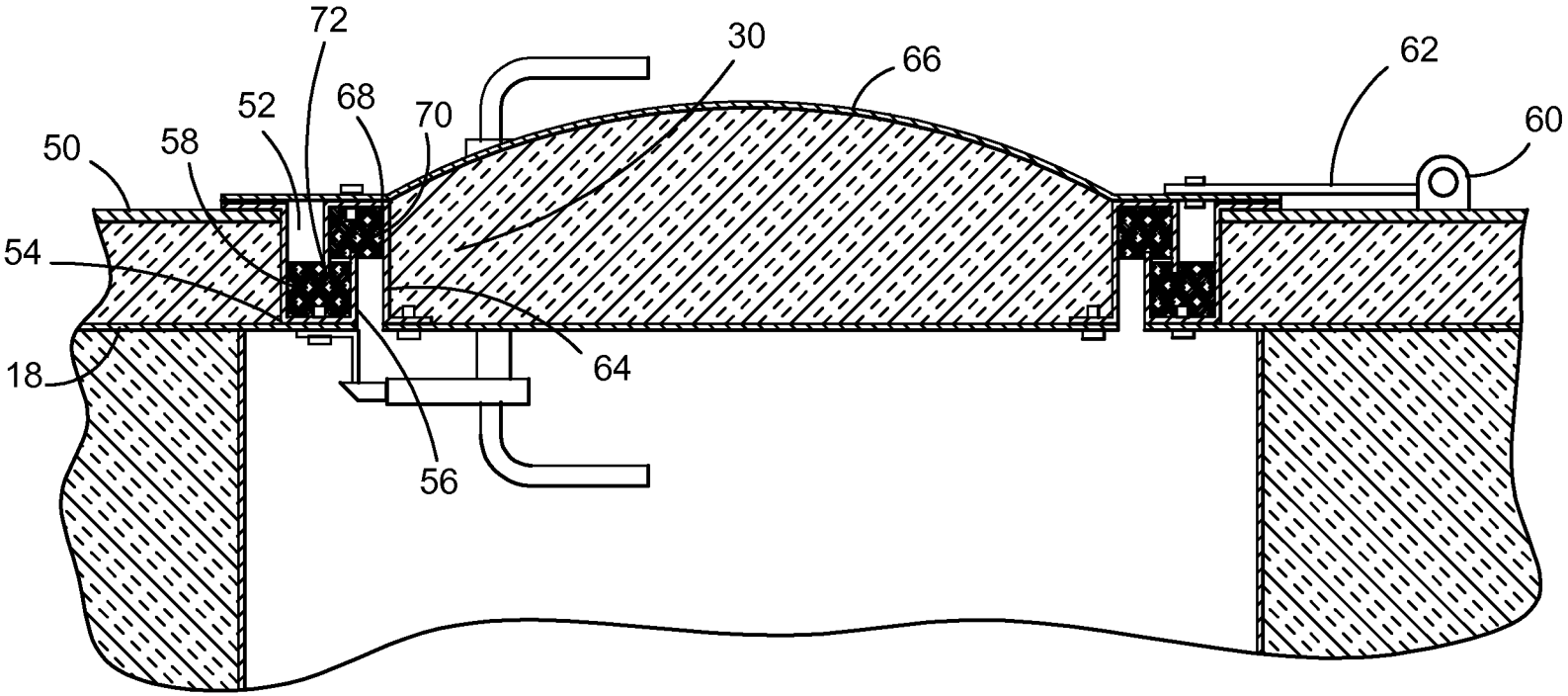
FIG. 15 is a section through a hatch depicted in FIG. 10.

The doors have the same paired smoke proof seals 54, 58, 68, 70 as used in the tank hatches in FIG. 15. A solar panel may trickle charge a battery inside the refuge to provide power for LED lighting and radio communication.

Figure 12:
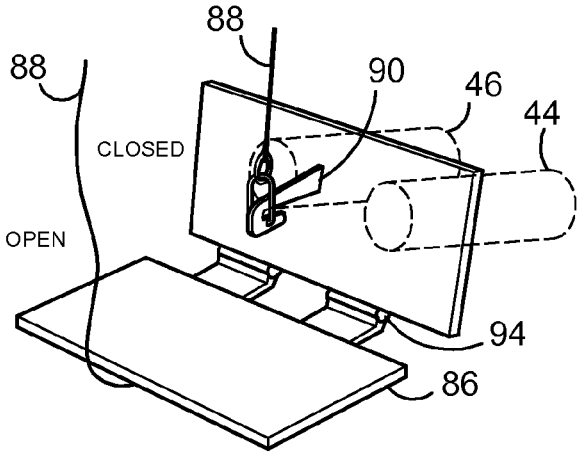
FIG. 12 is a perspective of a flap valve controlling water inflow.

Referring now to FIG. 12, the incoming port is a double port having two pipes 84 leading from the interior to an external plenum chamber (not shown) outside the outer shell. The pipes terminate in hose fittings inside duct 42 to which fire hoses are attachable. If the hoses dry and burn the hinged flap 86 can be closed by stainless wire line 88 acting on actuating lever 90. The tank is filled from an external pump. The inner shell is accordingly constructed as a tank and the hatches are operable from inside and outside.

Figure 13:
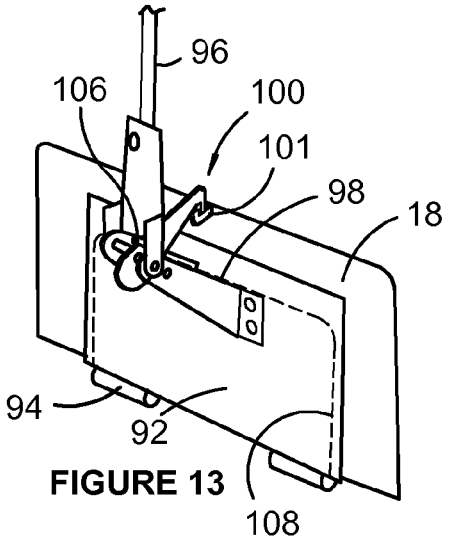
FIG. 13 is a perspective of a drain valve.
Figure 14:
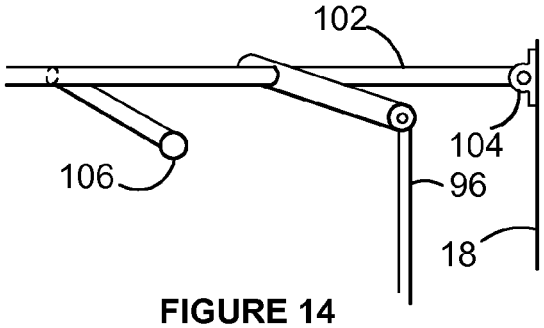
FIG. 14 is a diagrammatic side view of the handle for operating the valve of FIG. 13.

In FIG. 13, the drain is a flap valve 92 pivoted to the inner shell 18 by hinges 94. The rise and fall operating rod 96 acts on double bracket 98. A locking tongue 100 engages a detent 101 extending from the face of the inner shell urged by a rat trap spring. When the rod falls the operating rod 96 is operated from within the interior by manual movement of a first lever 102 (see FIG. 14) pivoted to a fulcrum 104 on the inner shell using handle 106 from outside the unit by operation of a second lever acting on an extension of the first lever 102. As the rod 96 falls, finger 106 rotates tongue 100 which unlatches from detent 101 against spring tension and further fall pulls flap 92 away from aperture 108.

The hatch construction is shown in FIG. 15. The top wall 50 of the refuge has an aperture 52 for each hatch and the edge defining the aperture has a rebate 54 which is surrounded by an upstanding circular flange 56. The rebate is annular and acts as a seat for a braided resilient seal 58. Insulation 30 fills the gap between the outer steel shell and the inner polymeric shell.

The underside of the inner shell has a pivot 60 which supports hatch swing arm 62. The hatch is made of a steel pan 64 covered by a convex steel cover 66 with insulation between. The pan has an annular seat 68 for a circular braided seal 70 like seal 58 but softer. Similarly the hatch has a downwardly depended circular flange 72 which engages seal 58. Thus the flanges establish a labyrinth seal at aperture 52.

Figure 16:
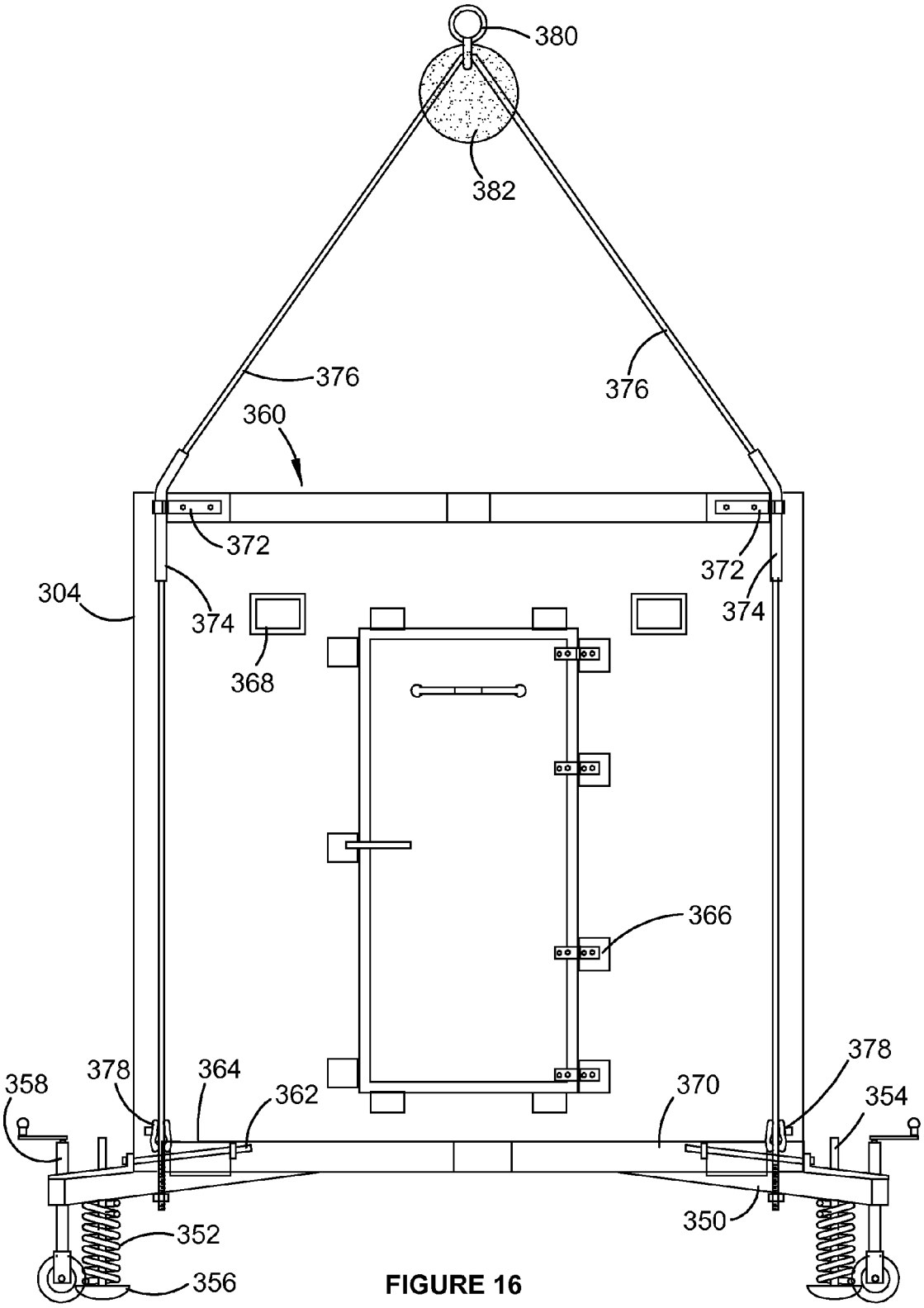
FIG. 16 is a perspective of a dry refuge which is intended to be carried to a site by helicopter to protect marooned firefighters.
Figure 17:
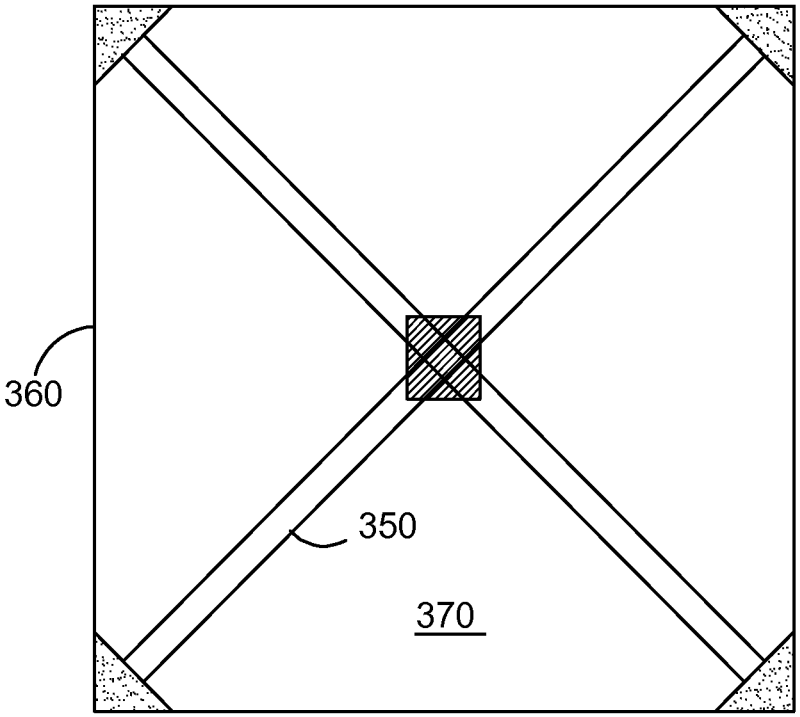
FIG. 17 is a plan view of the base of the airborne refuge as shown in FIG. 16.

Referring now to FIGS. 16 and 17, the unit is intended to be airlifted into fire threatened sites. The refuge has metal bearers 350 arranged as a cross. The rest of coil springs 352 which surround steel plunges 354 capped by domes 356. The refuge is rendered mobile by activating wind down jockey wheels 358 at the ends of the bearers 350.

A stainless steel cuboid box 360 forms the outer shell 1900×1900 mm and 2000 mm high. The box is attached to the bearers via by high tensile bolts 362 which pass through spacers 364. The outer shell is 1.6 mm 304 stainless steel. One wall has four stainless steel hinges 366 which support the door shown in FIG. 11. The same wall contains a flameproof optical viewer 368. The inner shell is made of fibreglass and the space between the shells is filled with 65 mm of fibre insulation as discussed in previous embodiments.

The floor 370 is made of layers of plywood in order to take the weight of the occupants.

The four upper corners of the box each have a stainless steel eye fitting 372 for holding angled tubes 374. These act as guides for two steel cables 376, each of which is attached to the end of a bearer 350 by a steel shackle 378. The two cables meet and cross at swivel eye 380 intended to receive the suspension hook of a helicopter. A foam ball 382 in a net is fixed beneath the swivel eye 380 to absorb impact when the eye detaches from the helicopter hook and falls on top of the box. Viewing port 368 allows the occupants to see the surroundings.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A refuge system for temporarily housing people in the event of fire, being a chamber with a base, walls, a roof and a door having a perimeter seal which is smoke proof, the chamber constructed from an outer metal shell, an external structural frame attachable to the base and adapted to give protection to the chamber from falling debris and weather, and an inner shell made of one of a plywood, synthetic polymer and fiberglass and resin, there being a space between the outer metal and the inner shells that is insulated with one or more layers of flexible insulation; wherein said one or more flexible insulation layers comprises two or more layers of insulation separated by intermediate adhered layers of aluminum foil.

2. The refuge system as claimed in claim 1, wherein the base has a floor which is not insulated.

3. The refuge system as claimed in claim 1, wherein the door has a labyrinth seal.

4. The refuge system as claimed in claim 1, wherein the inner shell is covered with said one or more layers of flexible insulation in blanket form.

5. The refuge system as claimed in claim 1, wherein said one or more layers of flexible insulation is of a sufficient depth to safely thermally insulate the inner shell even if the outer shell is exposed directly to a fire front.

6. The refuge system as claimed in claim 1, wherein said one or more layers of flexible insulation is supplied in rolls and is laid over the inner shell to build up a required depth.

7. The refuge system as claimed in claim 1, wherein said one or more layers of flexible insulation includes a fiber layer having a face that slides over a foil face of another insulation layer to assist in a cladding stage whereby the one or more flexible insulation layers are laid over the inner shell.

* * * * *